United States Patent [19]

Draugelis et al.

[11] 4,135,927

[45] Jan. 23, 1979

[54] MULTICOLOR XEROGRAPHIC PROCESS

[75] Inventors: Vaidevutis C. Draugelis; William R. Hartman, Jr., both of Rochester; Michael J. Langdon, Penfield, all of N.Y.

[73] Assignee: Xerox Corporation, Stamford, Conn.

[21] Appl. No.: 577,814

[22] Filed: May 15, 1975

Related U.S. Application Data

[63] Continuation of Ser. No. 39,689, May 20, 1970, abandoned.

[51] Int. Cl.[2] ..... G03G 13/01

[52] U.S. Cl. ..... 96/1.2; 355/8; 355/4; 427/18; 427/24; 118/657

[58] Field of Search ..... 96/1 R, 1 LY, 1.2, 1.4; 355/4

[56] References Cited

U.S. PATENT DOCUMENTS

| | | | |
|---|---|---|---|
| 2,890,968 | 6/1959 | Giaimo | 96/1.2 X |
| 3,043,686 | 7/1962 | Bickmore | 96/1.2 |
| 3,262,806 | 7/1966 | Gourge | 96/1 R |
| 3,368,894 | 2/1968 | Matkan et al. | 96/1 R |

FOREIGN PATENT DOCUMENTS

| | | | |
|---|---|---|---|
| 873080 | 7/1961 | United Kingdom | 96/1 LY |

*Primary Examiner*—Roland E. Martin, Jr.

[57] ABSTRACT

Method and apparatus are herein disclosed for xerographically reproducing a color copy from a multicolor original. A moving photoconductive surface is sequentially exposed through color filters to form a series of color separated latent electrostatic images thereon. Each image formulated contains original input scene information of selected colors recorded at a first image potential and other input scene information recorded at a second potential, the first recorded potential being greater in magnitude that the second recorded potential. Development of the images is achieved by passing an electroscopic developer material between the photoconductive surface and a control electrode biased to a potential somewhere between the first and second image potentials found on the photoconductor whereby recorded input scene information containing the selected color is developed and, simultaneously therewith, development of all other information is prevented. In this particular process, the color separated light images are formulated by passing reflected light from the multi-color original sequentially through red, green and blue filters and the images developed by applying a cyan toner to the red separated image, a magenta to the green separated image and a yellow to the blue separated image. The three developed images are placed in superimposed registration upon a final support material to produce a high fidelity copy of the multi-color original.

4 Claims, 13 Drawing Figures

INVENTORS
VAIDEVUTIS C. DRAUGELIS
BY WILLIAM R. HARTMAN
MICHAEL J. LANGDON
Thomas Hall
ATTORNEY

MULTICOLOR XEROGRAPHIC PROCESS

This is a continuation of application Ser. No. 39,689, filed May 20, 1970, now abandoned.

This invention relates to color xerography and, in particular, to method and apparatus for selectively controlling development in a color reproducing apparatus.

Basically, in conventional xerography, a photosensitive member consisting of a photoconductive layer and a conductive backing is first uniformly charged and the charged plate surface then exposed to a light image of the original subject matter to be reproduced. Under the influence of the light image, the photoconductive surface becomes conductive in light struck areas thereby selectively dissipating the charge in a manner to produce a latent electrostatic image in configuration with the original subject matter. The latent electrostatic image is generally made visible by contacting the highly charged image areas with an oppositely charged, finely divided, electroscopic marking powder. Areas of high charge concentration are recorded as images of high toner density while proportionately weaker charged areas are recorded as less dense images. After development, the powder images are conventionally transferred to a final support material, usually paper, and the images fixed thereto to form a permanent record of the original.

As known in the art, conventional xerography can be adapted to produce color copy by altering the basic process in some manner. In one such technique, the charged photoconductive member is sequentially exposed to a series of color separations of the original in order to form a plurality of latent electrostatic images. Each color separated image is then developed with a complementary toner material, that is, a developer material containing a colorant which is the subtractive complement of the color superimposing the images in registration on a final support sheet. The fidelity of the final copy produced by this technique is dependent to a large extent on how well the subtractive colorants mix or combine when brought together to reflect the colors found in the original. Heretofore, because of the nonselectivity of most known development systems, it has been extremely difficult to apply toners of one color to the appropriate imaged areas without contaminating other imaged areas with unwanted randomly dispersed particles of the colored material.

It is therefore a primary object of this invention to improve color xerography.

Another object of this invention is to overcome known limitations found in the xerographic color process.

Yet another object of this invention is to reproduce a high fidelity color copy from a multi-color original by selectively controlling development in a xerographic color system.

A still further object of this invention is to control background development in a xerographic color system.

These and other objects of the present invention are attained by means of a xerographic reproducing apparatus capable of reproducing selected colors from a multicolored original while simultaneously preventing the reproduction of other colors, the apparatus having means to formulate a color separated light image of the original input scene information within a predetermined spectral range containing the selected colors, means to expose a charged photoconductive surface to the color separated light image to record input scene information of the selected colors as electrostatic images at or about a first charge level on the photoconductor and to record all other input scene information containing other colors as electrostatic images at or below a second charge level on the photoconductor, developing means capable of passing electroscopic developer material between the photoconductor surface and an electrode, and biasing means associated with the electrode to place the electrode at a potential between the first charge potential and the second charge potential found on the photoconductive surface and being of a polarity so as to cause the recorded input scene information containing the selected colors to be developed and to simultaneously prevent development of all other recorded input scene information.

For a better understanding of the invention as well as other objects and further features thereof, reference is had to the following detailed description of the invention to be read in connection with the accompanying drawings, wherein.

Figure 1:
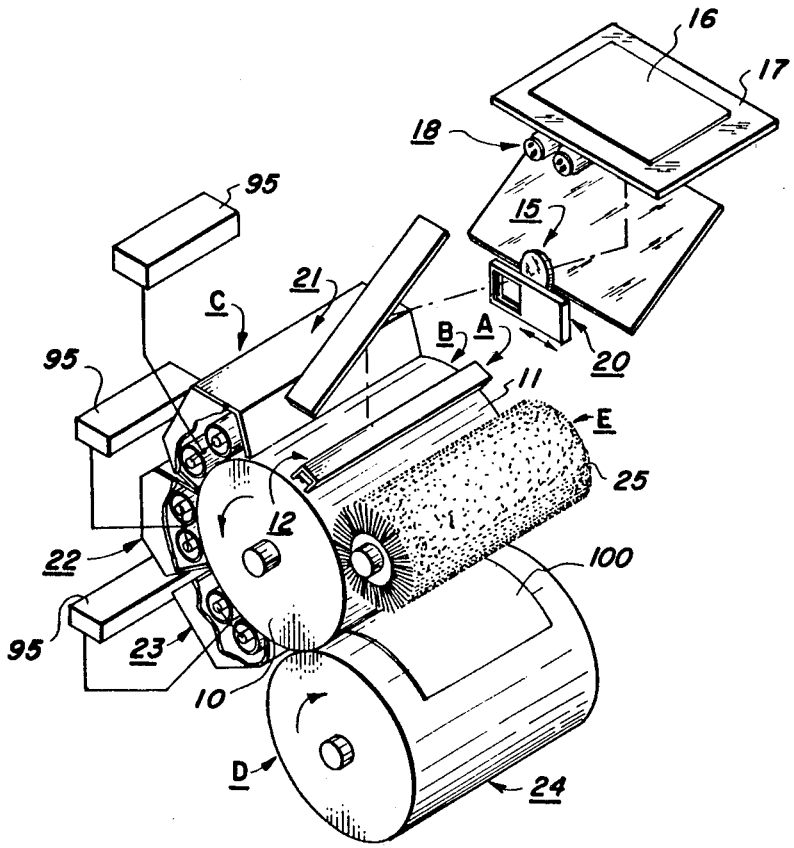
FIG. 1 is a schematic perspective view of an automatic xerographic reproducing machine embodying the features of the present invention.
Figure 12:
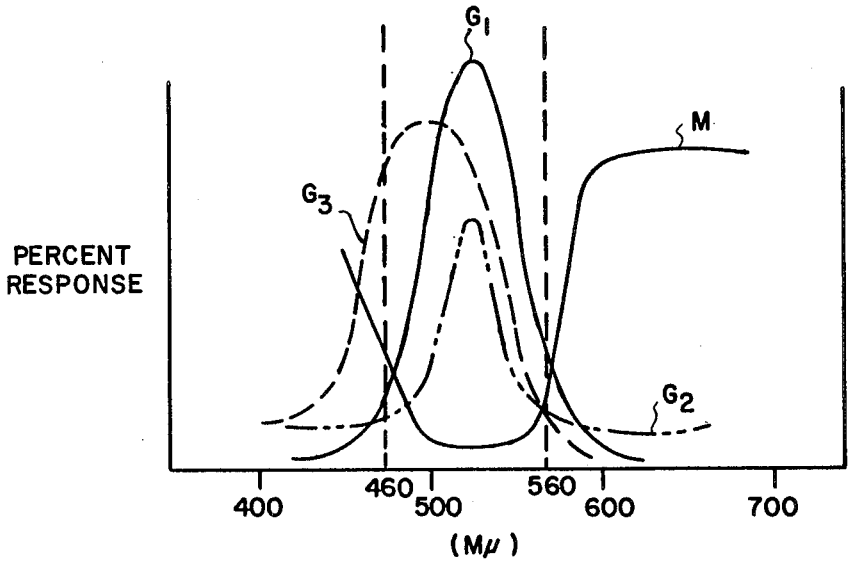
Figure 13:
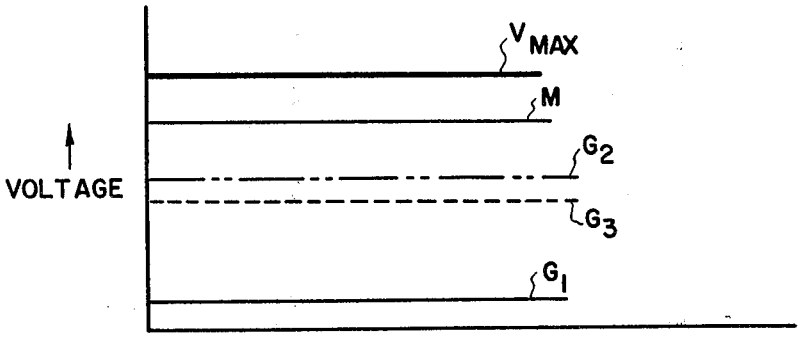

FIG. 12 is a graphic representation illustrating the characteristics typical of the color separation system utilized in the automatic machine shown in FIG. 1, the transmission and reflection properties being plotted against the wavelength of light; and FIG. 13 is a graphic representation of the recorded photoreceptor voltages caused by various reflected color images passed by an optical filter system having the characteristics shown in FIG. 12.

Referring now to FIG. 1, there is shown a schematic illustration of an automatic xerographic reproducing device for making color copies from a color original utilizing the teachings of the present invention. As will become clear from the disclosure below, the instant invention is well suited for use in a wide variety of xerographic machines and the teachings herein embodied are not necessarily restricted to the particular machine environment disclosed. Basically, the xerographic reproducing apparatus employs a rotatably mounted drum 10 having a photoconductive surface 11 thereon which is preferably formed of a material having a relatively panchromatic response to visible light. The drum is arranged to move the photoconductive surface sequentially through a series of processing stations as the drum is rotated in the direction indicated. The drum surface first passes through a charging station A in which is located a corona generating device 12 extending transversely across the drum surface and which is arranged to bring the photoconductive surface to a relatively high uniform charge potential.

The charge photoconductive surface is next transported through an exposure station B which includes a moving lens system 15 and a color filter mechanism 20. The original 16 to be reproduced is stationarily supported upon a transparent viewing platen 17 wherein successive incremental areas on the original are illuminated by means of a moving lamp assembly 18. The lens assembly 15 is adapted to scan the successive areas of illumination at the platen and to focus the light at the photoconductive surface. The lamp assembly and the lens assembly are moved in timed relation with the drum surface whereby a flowing light image of the original containing the input scene information is placed on the drum in a non-distorted manner. During exposure, selected color filters are interposed into the optical light path of the lens by means of the filter mechanism 20. As will be explained in greater detail below, the color filters operate on the light passing through the lens whereby the latent electrostatic image recorded on the photoconductive surface contains input scene information and color information.

Following the recording of the information on the drum surface, the drum is advanced to a development station C comprised of three individual developer units 21, 22 and 23. The developer unit are all of the type generally referred to in the art as "magnetic brush development units". Basically, in a magnetic brush development system, magnetizable developer material is continually brought through a directional flux field and a brush of developer material formed. Because of the motion of the developer particles, the brush is constantly being provided with fresh developer material. By bringing the brush into contact with the photoconductor, the desired development is effected. Each of the development units is arranged to apply a different colored toner material to corresponding latent electrostatic image containing color information on the photoconductive surface.

After development, the now visible images are moved sequentially to a transfer station D where the images are transferred to a sheet of final support material by means of a biased transfer roll 24. The surface of the transfer roll is electrically biased to a potential having a magnitude and polarity sufficient to electrostatically attract toner particles from the photoconductive surface to the final support sheet. A single sheet of final support material is supported on the transfer roll and the roll arranged to move in correlation with the photoconductive drum surface whereby each of the developed images is placed in superimposed registration upon the sheet. After the last transfer operation, the final support sheet is stripped from the roll surface and passed to further processing station (not shown) where the developer image is fixed to the copy sheet and the copy storage tray.

The last processing station in direction of drum rotation is a cleaning station E. A rotatably mounted fiberous brush 25 is positioned in the cleaning station and is arranged to maintain contact with the rotating drum surface to remove residual toner particles remaining on the drum after the transfer operation.

In the instant process, as in most subtractive color-to-color reproducing precesses, colorants (toners) containing the subtractive primaries yellow, cyan (blue-green) and magneta are employed to produce a wide gamut of colors found in the original. By subtractive mixing of the yellow and cyan colorants, greens are obtained. Similarly, mixing of magenta and yellow in varying amounts reproduces the reds and combining the cyan with the magenta results in the reproduction of blues. Mixture of equal amounts of each toner, of course, will produce a black image.

As in any color system, the first step in producing a color copy is to discern the color composition of the original subject matter and record this information in some usable manner. In the present apparatus, the color original is optically scanned a number of times to formulate a series of latent electrostatic images on the moving drum surface. Each light image is first passed through a color filter so that the latent image is in a sense color separated. Theoretically, a latent image formed by passing the light image through a green filter should record the magentas (the complementary color) as areas of relatively high charge density on the drum surface while the greens (the separated color) should cause the charged density on the drum surface to be reduced to an ineffective development level. The magentas are then made visible by simply applying a green absorbing magenta toner to the image bearing member. By the same token a blue separation is developed with a yellow toner while a red separation is developed with a cyan toner. The three developed color separations are then brought together in registration on a sheet of final support material to produce a color facsimile of the original document copy.

Referring more specifically to FIGS. 2–5, there is illustrated the optical scanning mechanism associated with the present automatic xerographic apparatus for producing a sequence of color separated images on the moving drum surface. Basically, the scanning system is made up of a stationary object mirror 13 and a stationary image mirror 14 having a moving lens assembly 15 interposed therebetween. A lens element 31 is mounted within the moving lens carriage 32 and the carriage slidably supported upon rails 33 by means of rollers 34 to move the lens transversely across the viewing platen. A lamp assembly 18 is movably supported below the platen and arranged to move in corporation with the lens carriage so that the lens continually scans between two aperture lamps 30 supported thereon. The movement of the lens carriage and the lamp assembly is correlated with the motion of the drum surface whereby each successive incremental area of an original illuminated at the platen is focused by the lens element on the drum surface. In this manner, a latent image, accurately recording the input scene information, is formed on the photoconductor. At the end of each scanning pass, both the lens carriage and the lamp assembly are restored to their original starting position to achieve what is herein referred to as a complete scanning cycle. For a more thorough description of the moving optical system herein described, reference is had to U.S. Pat. No. 3,062,109 issued in the name of Mayo, the disclosure of which is herein incorporated by reference.

Figure 2:
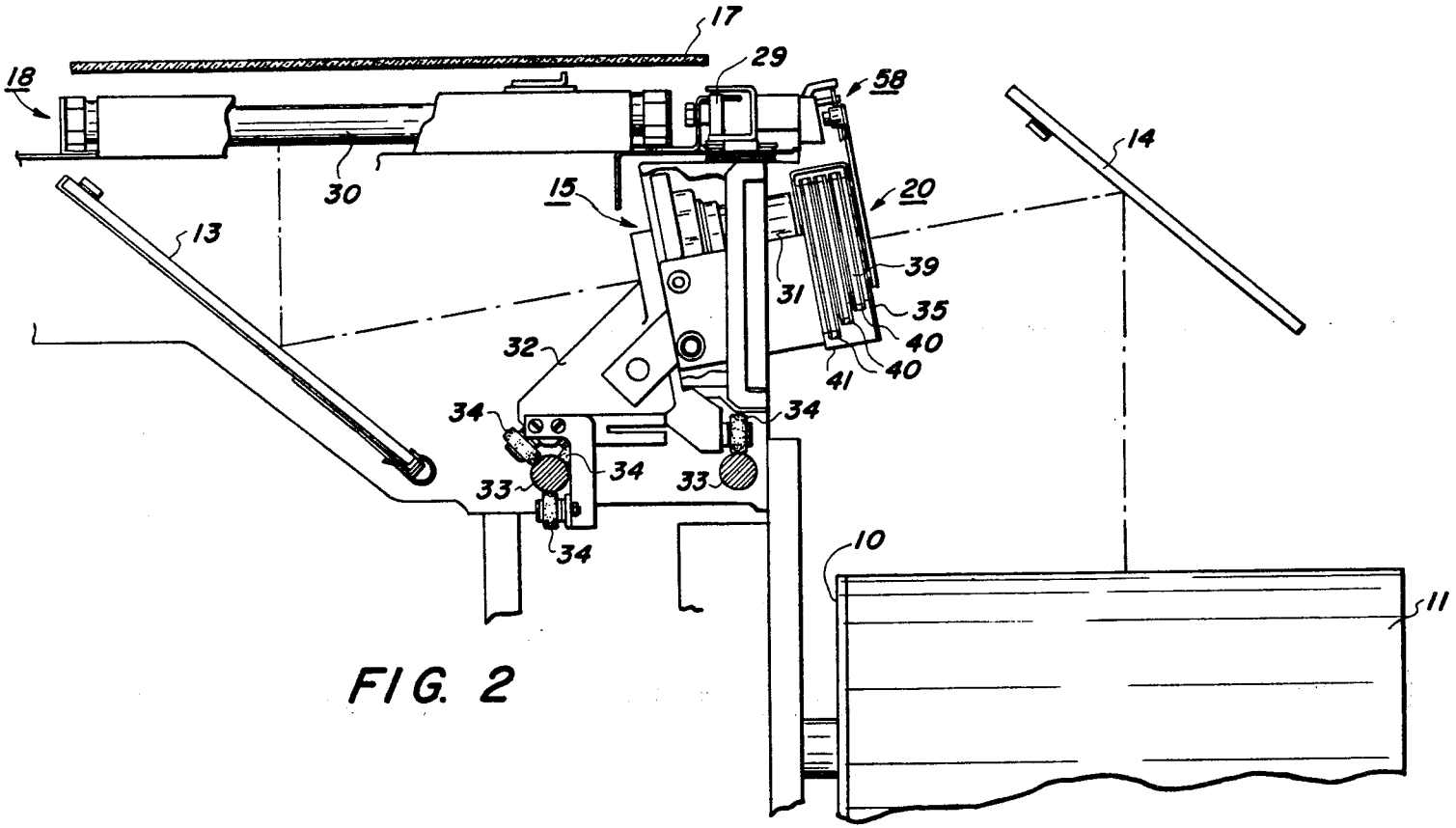
FIG. 2 is a more detailed side elevation of the exposure system employed in the automatic machine illustrated in FIG. 1 showing in detail the movable lens assembly and the color separation filter mechanism supported thereon.
Figure 3:
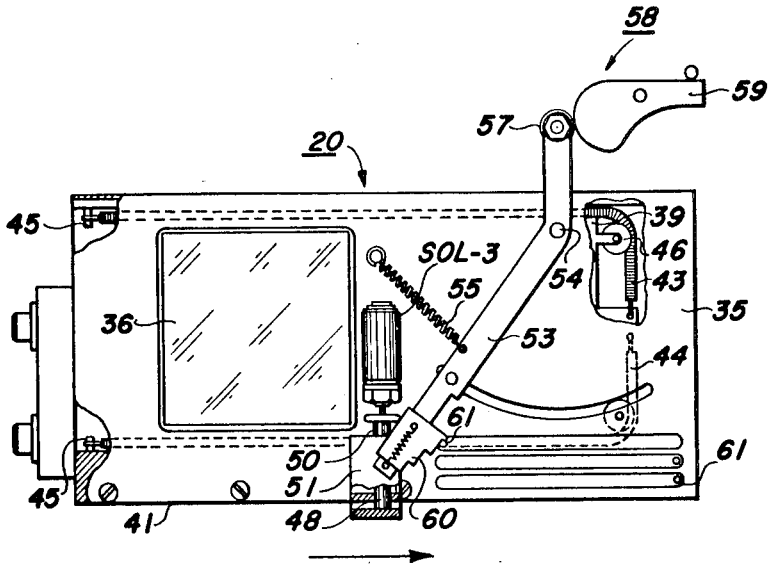
FIG. 3 is an enlarged front view of the color separation filter mechanism shown in FIG. 2 with portions broken away to more clearly show the filter actuation mechanism.
Figure 4:
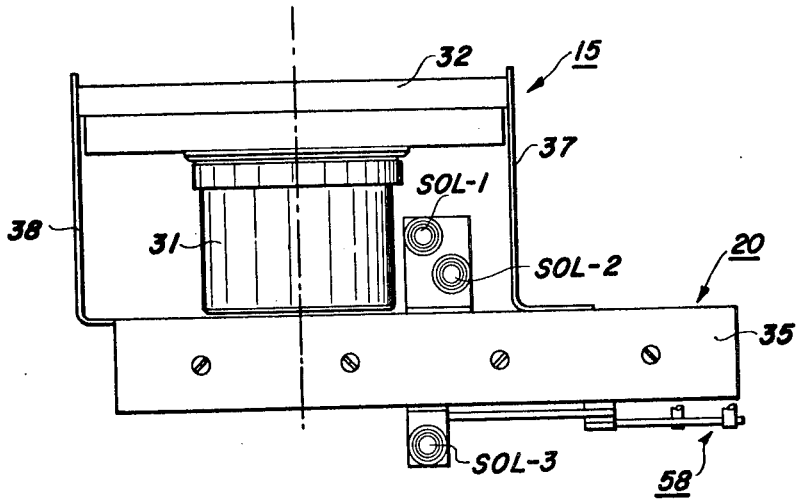
FIG. 4 is a plane view of the lens assembly and filter housing shown in FIG. 2.

An optical filter assembly 20 is affixed to the movable lamp carriage and is arranged to move in unison with the lens throughout the scanning cycle. The filter assembly primarily comprises a substantially enclosed filter housing 35 having a clear aperture 36 formed therein (FIG. 3). The filter housing is secured to the lamp carriage by means of two support brackets 37, 38 (FIG. 4) in a manner so that light transmitted through lens element 31 must pass through the aperture 36 provided in the filter housing. Three color filters are mounted within the body of the filter housing. The filters are supported in substantially identical frame members 39 adapted to ride in guide rails 40 provided in the lower wall 41 of the housing and rails 42 in the upper wall (FIG. 2). The filter frames are movably supported upon the rails and arranged to slide freely between a normally inoperative position where the filters are stored within the enclosed body of the housing and an operative position where the filter entirely fills the aperture 36.

A pair of extension springs 43, 44 act upon each of the filter frames tending to force the frames from the normally stored position towards the operative position. The individual springs are arranged to ride in the guide rail as illustrated in FIG. 3. The springs are affixed to the filter housing at one end by means of pins 45 and, after passing over pulleys 46, the opposite ends of the springs are secured to the backs of the individual frames in a manner so as to maintain a constant forwarding pressure on the frame members. To prevent activation of each frame, a retaining element 48 is passed upwardly through the bottom wall 41 of the filter housing and which precludes the frame members from being moved by the spring elements into the operative position.

Each of the three retaining elements is carried on an L-shaped bracket 51 secured to the actuator arms of control solenoids Sol 1, 2 and 3 that are secured adjacent to the filter housing. Actuation of the solenoids is programmed through the machine logic system to correlate filter selection with the development sequence whereby each color separated image is developed with the appropriate corresponding complementary toner material. Although any desired filter selection sequence can be practiced, it is preferred that a red, green and then blue sequence of operation be followed.

In operation, a selected filter is positioned in the filter housing aperture by activation of the associated solenoid. This, in turn, causes the retaining element to be removed from its holding position thus allowing the filter to be moved into the aperture under the biasing pressure of the spring elements 43 and 44. Return of the filter frame to a stored position is accomplished after each scanning pass, that is, during the period when the lens carriage is being restored to the start of scan position.

The return of the filter frame to a stored position is achieved by means of the lever arm and cam arrangement shown in FIG. 3. Lever arm 53 is pivotly mounted in the filter housing upon pivot pin 54 and is normally biased in the position shown by means of spring 55. As the lens carriage returns towards the start of scan position, a cam follower 57 supported in the upper end of the lever arm, is driven into contact with a camming mechanism 58. The cam follower moves in contact with the working profile of a segmented cam element 59 and translates a motion to the lever arm which causes the arm to swing in a counter clockwise direction (FIG. 3). A pin 61 associated with each of the filter frames, extends through the slotted opening provided in the filter housing side wall and is arranged to be picked up by the swinging arm. The lower portion of the lever arm has a pick up element 60 affixed thereto which is adapted to operatively contact any one of the pins as the arm swings in a counter clockwise direction and slides the frame back to a normally stored position. At this time, the solenoid is de-energized and a spring element (not shown) acts upon retaining element 48 tending to pull the element into a locking position. Solenoid is only energized to release filter; on the return of scan, the spring load retaining element 48 snaps in locking position. The cam profile of element 59 causes the arm to swing sufficiently to reposition the frame in a fully stored position allowing the retaining pin to be drawn upwardly into a locking or holding position. The arm is then released by the cam element and the exposure system is now in a condition to commence the next subsequent scanning pass. As shown in FIG. 3, the cam element is supported in the main frame assembly in a manner to permit the element to swing freely in a counter clockwise direction. As the lens element starts forward at the beginning of the next subsequent scanning cycle, the lever arm drives the segmented cam element back permitting the arm to move thereunder in an undisturbed manner.

For each color reproduction cycle, three distinct color separated images of the original are formulated on the photoreceptor. Through means of the machine control logic system (not shown) the relative spacing between the images is controlled so that the lead image (red filtered) is moved into a first color development unit 22 (FIG. 1) and the unit activated. At this time, the first image, the red separated image, is developed with a cyan toner while the other two developer units 21 and 23 are held inactive. After the lead image has moved out of the influence of the first developer unit, the next subsequent image (green separated) on the photoconductor is brought into operative communication with developing unit 21 and the image developed with a magenta toner. Finally, the third image (blue separated) is similarly developed with a yellow toner by means of the third developer unit 23. As can be seen, in this three color subtractive process, the colorants cyan, magenta and yellow are used to control the reds, greens and blues found in the final copy. It should be clear to one skilled in the art that the teachings of the present invention are not limited to use of color filters as herein described and any means of forming a color separation of the original capable of providing the desired control may be similarly employed.

The three development units employed in the present machine are substantially identical as to their operation in that each unit utilizes the magnetic brush technique. Because each of these units operates in substantially the same manner, only one of the units will be described in greater detail below.

Figure 5:
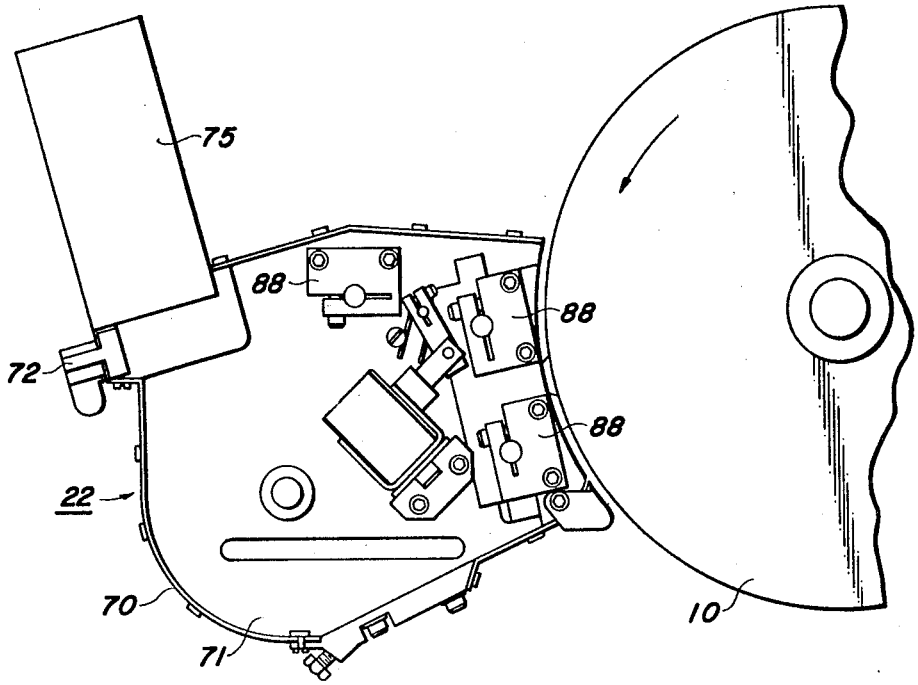
FIG. 5 is an enlarged side elevation of one of the developer units employed in the automatic reproducing machine of FIG. 1 showing the unit mounted in operative relation with the movable photoconductive surface.
Figure 6:
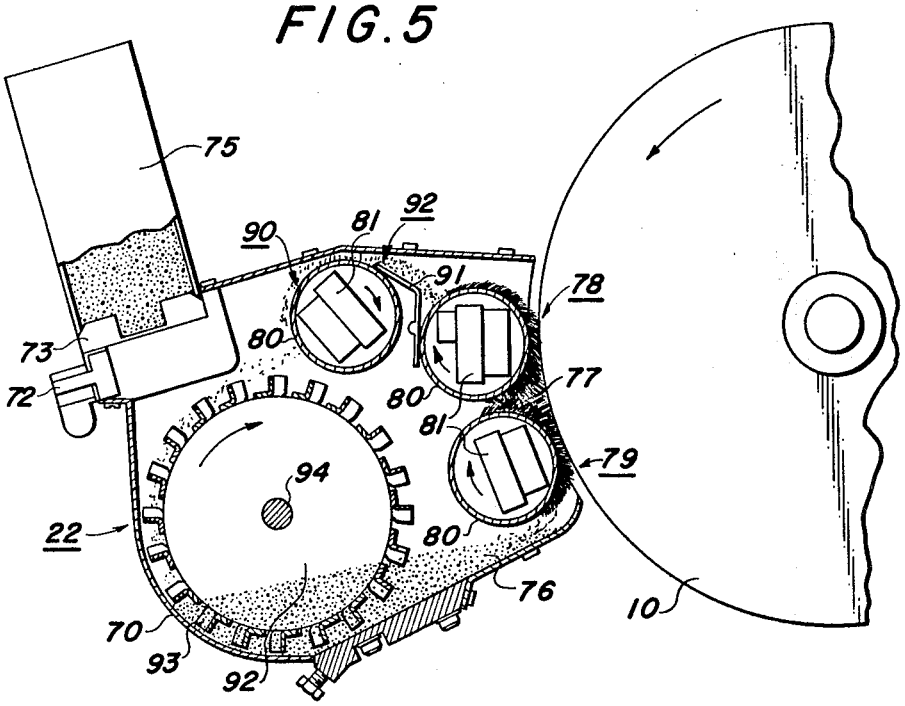
FIG. 6 is a sectional view of the development unit shown in FIG. 5 illustrating in further detail the apparatus to apply developer material to the photoconductive surface.
Figure 7:
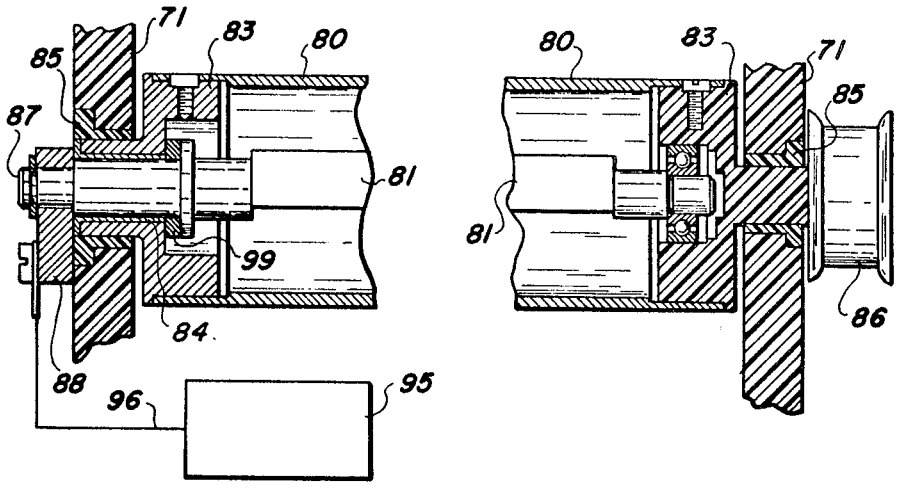
FIG. 7 is a partial view in section of one of the developer applicator rolls shown in FIG. 6 illustrating the roll biasing mechanism.
Figure 8:
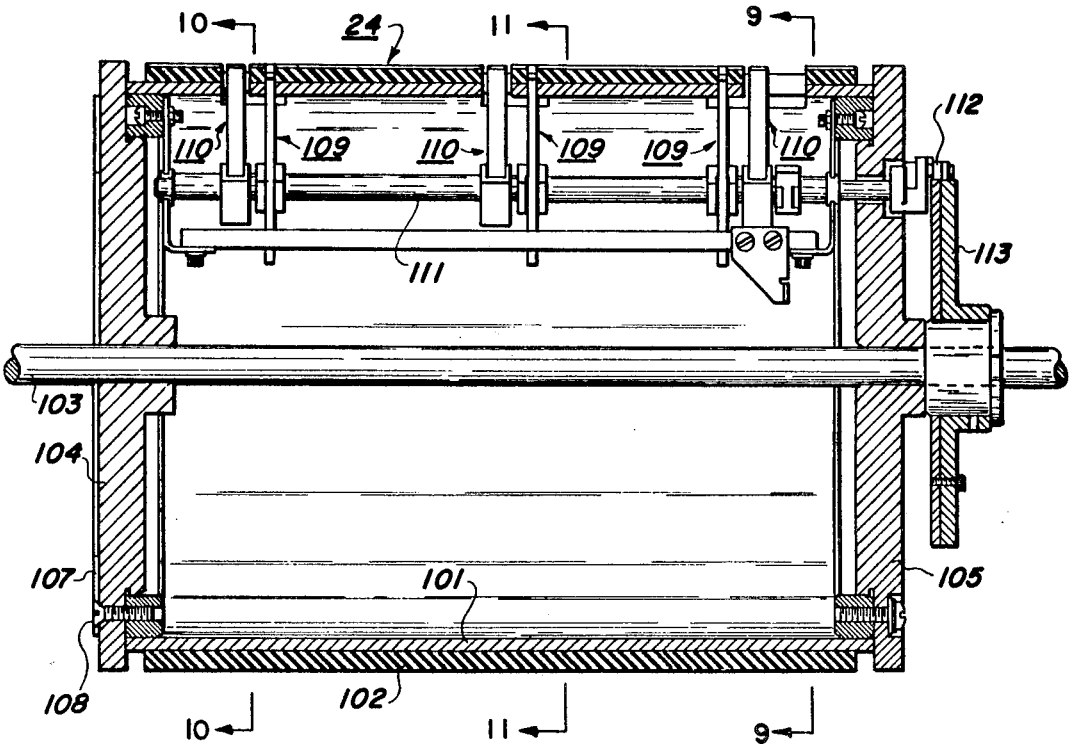
FIG. 8 is a front elevation in section of the image transfer apparatus utilized in the automatic reproducing machine shown in FIG. 1.
Figure 9:
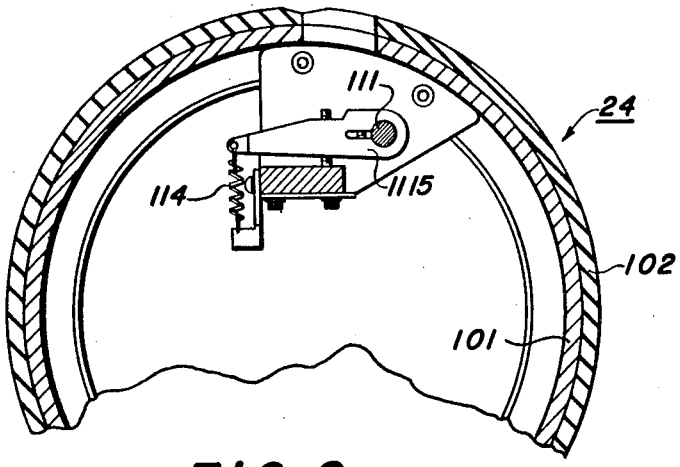
FIG. 9 is a partial view in section taken along line 9—9 in FIG. 8 showing the spring loaded shaft to which the paper stop and paper gripping fingers are actuated.

Referring now specifically to FIGS. 5-7, there is illustrated the specific structure of development unit 22. The unit basically is arranged to coact with the moving drum surface 10 to form a substantially enclosed unit capable of supporting a quantity of developer material therein. The developer unit is formed of a main trough-like housing 70 that is closed at both ends by means of end plates 71. The main housing is secured adjacent to the photoconductor by suitable bracket means 72. A support 73 is carried on the upper part of bracket 72 and secures toner dispensing unit 75 to the developer unit.

A reservoir or sump area 76 is provided in the bottom portion of the developer housing as a storage area for two component developer material comprised of a magnetizable carrier bead and colorant containing electroscopic toner particles. The toner particles are generally many times smaller than the carrier beads and, due to the triboelectric forces involved, the toner particles become charged and adhere to the carrier beads in a charged state. Toner dispenser 75, acting through its control mechanism (not shown) replenishes the developer mix with fresh toner as the mix becomes deplete during the development process.

Development of the photoreceptor is accomplished by bringing the image bearing surface into contact with a moving brush 77 of developer material. The blanket like brush is formed by introducing a steady stream of developer material from the sump area into the development zone between the photoconductor surface and developer rolls 78 and 79. As illustrated in FIG. 6, the rolls are mounted in close parallel relationship to each other adjacent to, and extend transversely across, the photoconductive surface. Each of the rolls includes a tubular applicator sleeve 80 and an elongated directional magnet system 81. The applicator sleeve is formed of a non-magnetizable, conductive, material which permits the directional force field of the magnet to freely pass therethrough. The applicator tubes are supported in end caps 83, and 84 which, in turn, are journaled for rotation in oil impregnated bearings 85 and shown in FIG. 7. Right hand end cap 84 extends through the side wall of the developer housing and has affixed thereto pully means 86 by which the applicator sleeve is rotated. The pulley is driven by any suitable means of driving power (not shown) capable of driving the applicator sleeve in the direction indicated at the desired rate.

As shown in FIG. 7, the left hand end of the directional magnet is supported on a stub shaft 87 that passes through the side wall of the developer housing and is supported in the bearing block 88 (FIG. 5) provided. The opposite end of the magnet is journaled in end cap 84 by means of a roller or ball bearing so that the applicator sleeve can rotate about the closed magnet. In operation, the magnet is supported within the sleeve so that the main flux field is directed into the development zone. The applicator sleeves are rapidly rotated in the direction indicated to move a continuous flow of developer material through the development zone. In this manner, a blanket-like brush of developer is built which is capable of continually presenting optimumly toner carrier beads to the photoconductive surface.

Control over the amount of developer material moving through the development zone is provided by supply roll 90 and a gate assembly 91 which are positioned in the upper part of the housing near the start of the development zone. The supply roll 90 is similar in construction to the development rolls herein described. A continuous supply of developer material is brought into contact with the supply roll by means of lifting and mixing element 92 rotatably supported within the developer housing upon shaft 94. A series of spaced vanes or blades 93 are mounted about the outer periphery of the lifting element and serve to convey developer material from the reservoir into contact with the supply roll as the lifting element is rotated in the direction indicated. The blades are mounted in a herring bone configuration and, as the blades move through the reservoir area, convey developer material from the outer edges of the developer sump to the central portion thereof producing cross mixing of the material thereby eliminating localized toner starvation.

The applicator sleeve 80 associated with the supply roll 90 is rotated at a rate sufficient to move a continuous stream of developer material towards mechanical gate 91. The gate is positionable to either pass the developer material into the active development zone or, in the alternative, to return the material back to the developer sump. The positioning of the gate is controlled through the machine control logic network so that no developer material is delivered into the active development zone when the unit is not in a developing mode of operation.

Color is a difficult term to define. What appears to be a rich true color to one person might appear to another as something entirely different. Colors exist in various hues or shades and each hue can be further broken down as to its characteristic brightness (saturation) and/or value (gray content). Physically, color is visible light energy and therefore occupies a region of the electromagnetic wave spectrum. The wavelength of light alone, however, does not completely describe the physical property of a color. The manner in which the light energy is distributed must also be considered. For example, green defines a family of colors or hues within the spectrum which exists at wavelengths between roughly 480 and 560 microns. However, because of hue or value, the specific color can better be described by further defining the exact wavelengths involved and the manner in which the light energy is distributed.

It should be made clear at this point that a specific color, as for example red, green, blue or the like, as herein used, refers to a family of colors within a specific region of the electromagnetic wave spectrum.

It has been found that in xerography it is possible to isolate selected colors by filtering the light image used to expose a charged photoconductive plate. Furthermore, by use of known filtering and imaging techniques, the exposure can be controlled so that input scene information containing the selected colors is electrostatically recorded on the photoconductive surface at a higher image potential than other input scene information.

The effect this exposure process has on a photoconductor may be best illustrated by example. The present systems response is explained in detail below in connection with a green filter-magenta development sequence. This particular sequence has been selected only for explanatory purposes and, it should be clear to one skilled in the art, that the described manner of operation is typical for each of the filter-development sequences employed by the present apparatus and in no way limits the present invention.

Referring now specifically to FIG. 12, there is graphically illustrated a series of spectral response curves for the optical system utilizing a green filter. In this figure, the spectral response are plotted against wavelength of light. The response referred to is basically a resultant quantity which is dependent upon many factors and includes the reflective characteristics of the original image as well as the transmitting properties of the optical system. The filter is arranged to pass light existing at wavelengths between approximately 470 and 570 millimicrons while affectively blocking all other light; this band pass being represented by the area between the two vertical dotted lines on the graph.

The spectral response to a "true" green is depicted by the area under the curve referenced $G_1$ in FIG. 12. A "true" green by definition is one which reflects a high percentage of the total input illumination concentrated at wavelength capable of being passed by the filter. By the same token, a magenta is typified by those images which reflect light primarily at wavelengths effectively blocked by the filter and is represented by the curve M. As previously noted, however, greens may exist in many different hues and values. The spectral response to two such "off" greens is illustrated by the curves $G_2$ and $G_3$.

Curve $G_2$ represents the spectral response to a green having a relatively high gray scale value while curve $G_3$ typifies the systems response to a blueish-green hue. As can be seen, curve $G_2$ follows closely the energy distribution curve of the true green. However, because of its gray content, considerably less of the available input energy is transmitted by the system. On the other hand, response curve $G_3$ shows that a good deal of the input illumination is reflected by the original image but, because the energy is concentrated primarily at the blue end of the green spectrum, much of the energy is blocked by the filter.

The effect of the systems response to color on a charged photoconductive plate is illustrated graphically in FIG. 13. The curve referenced V max represents the maximum plate voltage for a typical photoconductive member, that is, the voltage to which the plate is initially charged. A "true" green image transmitted through the green filter imaging system will effectively reduce the plates potential to a relatively low level, ($G_1$) that is, a level close to the background potential. The term background, as herein used, refers to the voltage recorded on the plate when the plate is exposed to light reflected from a sheet of white paper supported at the viewing platen. The magentas in the original, on the other hand, are effectively blocked by the filter and are recorded as areas of relatively high potential on the plate which are relatively close to the initial charge potential. The magenta induced voltages are illustrated by the curve labeled M in FIG. 13.

The "true" green images and the magenta images pose no serious problem in conventional xerography. The magenta images would normally be developed while the true green images, being at a much lower potential, inherently remain undeveloped. The response of the system to other than true green images, however, results in latent images being recorded at various potential levels somewhere between the background voltage and magenta image voltage. The system typically responds to a green image of high gray content in a manner illustrated by the curve $G_2$ in FIG. 13 and as can be seen, the recorded image voltage is at a high potential, usually somewhat below the magenta image voltage depending on the input image density.

The system responds to images having other than a "true" green hue in a similar manner. The plate voltage recorded for a blue-green image, as described in reference to FIG. 12, typically will be found somewhere between the $G_1$ voltage and the magenta image voltage. The curve referenced $G_3$ in FIG. 13 exemplifies a voltage recorded for a blue-green image.

As can be seen from the example above, each color separation is capable of recording electrostatically a great deal of color iinformation on the photoconductor which could be improperly developed if the situation is left uncorrected. To accomplish this correction, each applicator sleeve included in the developer roll assemblies is biased to a potential having a polarity similar to the image charged potential found on the plate surface and being of a magnitude somewhat below that of the recorded image wished to be developed. For instance, in the green filter - magneta development sequence described above, the biased potential on the applicator sleeve is placed at a potential somewhere between the potentials M and $G_2$ as shown in FIG. 13, preferably closer to G. When a latent image containing other than magenta color input scene information of a desired input density is moved into the active development zone, the higher electrostatic force field associated with the applicator roll predeominates causing the toner material in the magnetic brush blanket to be attracted towards the applicator roll side of the development zone to prevent toner from being deposited in these areas. Conversely, when a recorded of a magenta image or other input information blocked by the filter, i.e. black, is moved through the active development zone, the higher electrostatic force fields associated with the image areas predominate and toner materia l moving in the developer flow is forced into these areas to effect development. Satisfactory results have been obtained in this type of system by biasing the applicator sleeves to approximately 20 volts above or below the plate potential that is not to be developed, that is color information outside the selected range.

Biasing of the individual developer roll is achieved by means of the electrical arrangement shown in FIGS. 1 and 7. Each developer roll is electrically isolated from other machine components and developer components by supporting the rolls and bearing in non-conductive developer side walls 71. A biasing source 95 is electrically connected to the applicator sleeves associated with each of the rolls by means of line 96 acting through connector 97. As shown in FIG. 7, connector 97 is affixed to conductive bearing block 88 and current is brough to the sleeve 80 through the circuit comprised of black 88, oil impregnated bearing 84 and end cap 83. Any suitable biasing means may be used in the practice of the present invention. However, it is preferred that the biasing source be such as to maintain the applicator sleeve at a stable DC potential level.

After each individual colored image is developed on the photoconductive surface, the images are transferred to a single sheet of final support material, preferably white bond paper. Transfer of these images is affected by means of a biased transfer roll 24 positioned in transfer station D (FIG. 1). The transfer roll is arranged to convey a single sheet of support material through the transfer zone in synchronous moving relationship with the developed images on the drum surface whereby each successive image is superimposed in registration upon the previous image. Preferably, when the toners are of varying degrees of opacity, the most opague toner is placed on the sheet first with the other toners superimposed thereon in an order corresponding to their relative opacity.

As illustrated in FIGS. 8–11, the transfer roll comprises a conductive core 101 having a non-conductive sleeve 102 thereon and is supported upon shaft 103 by means of end supports 104 and 105. The end supports are fabricated of a dielectric material and act to electrically isolate the transfer roll from the machine frame. An electrical commutator 107 is affixed to the outside surface of end support 104 and electrically communicates with the core through means of the circuit established by the connector 108. A brush (not shown) is arranged to ride on the commutator ring to provide a moving contact by which the conductive core is electrically connected to a suitable source of electrical power capable of raising the potential at the surface of the roll to a level sufficient to overcome the electrostatic forces holding the toner image to the photoconductor. The bias level is stepped in a manner such that each subsequent image is subjected to a slightly higher transfer field than the previously transferred image.

The registration stops and gripper fingers are provided to facilitate aligning and securing the final support sheet to the transfer roll. The stops and fingers are both operatively associated with a single control shaft 111 internally supported within the transfer roll. The shaft extends through dielectric end support 105 and has a cam follower 112 affixed thereon which rides in contact with the working profile of control cam mechanism 113. As more clearly illustrated in FIG. 9, shaft 111 is normally biased in a counter clockwise direction by means of spring 114 acting through arm 115. The biasing action of the spring holds the cam follower 112 in continuous contact with the working face of the control cam 113 throughout the motor cycle. The motion translated through the cam system is programmed to actuate the registration stops and the gripper finger in coordination with paper feeding means (not shown) to accurately align and secure the individual copy sheets to the roll surface.

Figure 11:
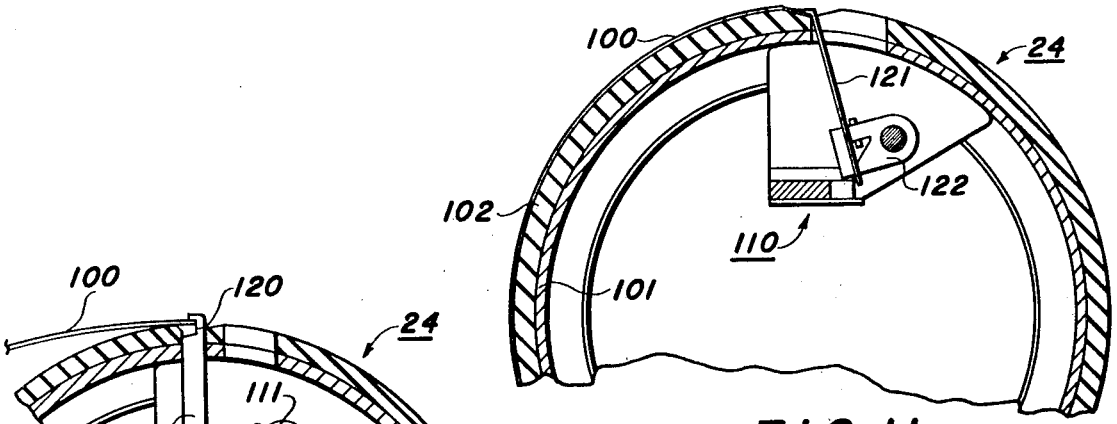
FIG. 11 is also a partial view in section taken along lines 11—11 in FIG. 8 showing a registration stop mechanism aligning the leading edge of a sheet of final support material.
Figure 10:
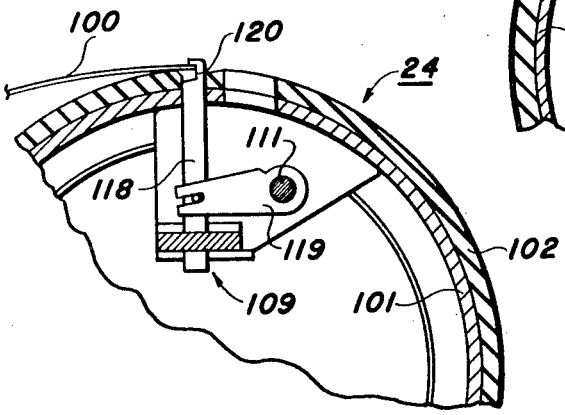
FIG. 10 is a partial view in section taken along line 10—10 in FIG. 8 showing the gripper bar mechanism engaging a sheet of final support material.

In operation, the sheet feeding apparatus drives a single sheet of final support material into the extended stops as shown in FIG. 10. The prescribed motion translated by the control cam rotates shaft 111 in a direction to extend the stops 118 from their normally stored position within the roll to a sheet receiving and aligning position as illustrated. After registration, the control cam causes shaft 111 to rotate in the opposite direction wherein the registration stops are stored and previously raised gripper bars 121 are pulled downwardly by support element 122 into engagement with the leading edge of the support sheet 100 as shown in FIG. 11. The gripper bars are arranged so that the L-shaped tabs on the end thereof engage the top leading edge of the sheet and pull the sheet downward into locking engagement with the roll surface.

It should be noted that the copy sheet is advanced slightly on the biased transfer roll surface during the sheet gripping operation so that the body of the copy sheet now overlies the opening through which the registration stop pins are extended. With a copy sheet locked in registration, a transfer potential is now applied to the roll surface by means of the commutator arrangement previously disclosed and the desired number of transfer steps performed. After the transfer sequence has been accomplished, the registration pins and gripper fingers are extended to push the body of the copy sheet away from the roll surface into a position where the sheet can be manually engaged by further sheet handling means for forwarding the sheet to a subsequent image fixing station where the superimposed registered images are fused in some known manner to the support material.

A color-to-color system was constructed as herein described in which a uniformly charged photoconductor was exposed to a series of light images from a color original by passing the reflected light therefrom sequentially through a red filter, a green filter and finally a blue filter. The individual color separated images were recorded on a selenium-type photoconductive surface initially charged to approximately 850 volts. The three color filters and/or lens aperture were adjusted so that reflected white light from the original reduced the charge potential on the selenium plate to approximately 120 volts. The formulated latent images were then developed or made visible by applying cyan toner to the red separation image, magenta to green, and yellow to blue. The developer rolls associated with the cyan development unit were set to a bias level of approximately 300 volts while those associated with magenta development units were set to approximately 450 volts and the yellow unit to approximately 400 volts and the corresponding color separated images then developed. The three images so developed were then transferred in superimposed registration to a sheet of final white bond support material employing the stepped bias transfer technique herein described. The color rendition made by this subtractive process produced a faithful copy reflecting the reds, greens, blues, cyans, magentas, yellows and blacks found in the original composition.

Although the present invention has been herein disclosed with reference to specific structure, processes and operating ranges, it should be clear that the invention is not necessarily confined to the particular details as set forth. For example, the exposure development sequences need not be limited to the number and colors herein disclosed and the bias voltages will, of course, vary in regard to the materials employed. It should be also clear that this application is also intended to cover any other modifications or changes that may come within the scope of the following claims.

What is claimed is:

1. The method of reproducing a color copy from a multi-color original; the steps including separating a plurality of primary colors from the multi-color original to create at least two light images having a greater illumination intensity in those regions containing information relating to the primary color than in regions containing information concerning other colors, sequentially exposing a uniformly charged photosensitive plate to each of said color separated light images to provide a latent electrostatic image corresponding to each of said light images on said plate with image primary color information recorded at a charge level below a predetermined potential and those regions containing other color information recorded at a charge level above said predetermined potential, developing each of said color separated electrostatic images selectively with electroscopic developing powder having a colorant capable of absorbing light energy in the spectral domain of the individual image primary color by magnetically bringing said developing powder into developing relationship with the image associated with said primary color while holding other developing powder inoperative;

providing individual preset developing biases for each of said electroscopic developing powders at least equal to the predetermined charge potential for the latent image being developed to suppress developing of image areas below said predetermined charge potential, and transferring each of the developed images to a single sheet of final support material upon the completion of each developing operation whereby a faithful color reproduction of the multi-color original is produced.

2. The method of claim 1 wherein the developed images are transferred to said sheet in an order corresponding to the degree of opacity of the electroscopic powder whereby developed images of lesser opacity are superimposed on developed images of greater opacity.

3. In the method of producing color copies of a multi-color original, the steps comprising:

a. separating said original into a plurality of primary color images;

b. sequentially exposing a charged photosensitive member in the order of decreasing colorant opacity to create a series of corresponding latent electrostatic images on said photosensitive member;

c. developing each of said latent electrostatic images by magnetically bringing from a series of different colorant electroscopic developing materials that developing material having a colorant capable of absorbing light energy in the spectral domain of the individual latent image being developed in the order of decreasing colorant opacity;

d. associating an electrical potential with each of the developing materials at least as high as the potential of the charge representing the primary colorant of the image being developed; and e. transferring in the same sequence and in registered relationship each of the images developed onto a copy substrate material to form a multi-color copy of said original.

4. In the method of reproducing a color copy from a multi-color original, the steps which comprise:

forming a first color separation image of the most opaque primary color of said multi-color original;

exposing a uniformly charged photosensitive member to said first color separation image to selectively discharge said photosensitive member in accordance with said first color separation image outline to thereby produce a latent electrostatic image of said first color separation image on said photosensitive member;

developing said latent electrostatic image with electroscopic developing powder having a colorant capable of absorbing light energy in the spectral domain of said primary color by magnetically bringing said developing powder into developing relationship with said latent electrostatic image;

influencing said developing with an electrical bias having a potential at least equal to the charge potential of those portions of said latent image reflecting areas of said primary color;

transferring the image developed to a copy substrate material to form a first developed color separation of said multi-color original;

forming at least a second color separation image of a less opaque primary color of said original;

exposing said uniformly charged photosensitive member to said second color separation image to selectively discharge said photosensitive member in accordance with said second color separation image outline to thereby produce a latent electrostatic image of said second color separation image on said photosensitive member;

developing said second separation latent electrostatic image with a second electroscopic developing powder having a colorant capable of absorbing light energy in the spectral domain of said second image primary color by magnetically bringing said second developing powder into developing relationship with said latent electrostatic image;

influencing said magnetic developing with a second electrical bias at a potential at least equal to the charge potential of those portions of said second latent image reflecting areas of said second primary color; and transferring said second developed image in registered relationship with the first image transferred to said copy substrate material to form a multi-colored copy of said original.

* * * * *